United States Patent [19]

van Ginkel et al.

[11] 4,245,944

[45] Jan. 20, 1981

[54] DEVICE AND METHOD FOR SEIZING A BAG

[75] Inventors: Mannes van Ginkel; Jan Plug, both of Barneveld, Netherlands

[73] Assignee: Moba Holding Barneveld B.V., Barneveld, Netherlands

[21] Appl. No.: 949,159

[22] Filed: Oct. 6, 1978

[30] Foreign Application Priority Data

Oct. 17, 1977 [NL] Netherlands ..... 7711355

[51] Int. Cl.[3] ..... B65B 43/16; B65B 43/26

[52] U.S. Cl. ..... 414/330; 53/384; 53/572; 271/24; 271/149

[58] Field of Search ..... 414/330, 786, 120, 128; 271/19, 20, 21, 22, 23, 16, 17, 30 A, 149, 150, 24, 25; 53/384, 571, 572, 573

[56] References Cited

U.S. PATENT DOCUMENTS

| | | | |
|---|---|---|---|
| 609,968 | 8/1898 | Larson | 271/21 |
| 747,862 | 12/1903 | Dexter et al. | 271/19 |
| 2,509,320 | 5/1950 | Smith et al. | 53/572 |
| 3,253,824 | 5/1966 | Southwell et al. | 271/22 X |
| 3,430,409 | 3/1969 | Manfredonia et al. | 53/573 X |
| 3,747,919 | 7/1973 | Stewart et al. | 271/19 |
| 3,789,573 | 2/1974 | Crabb | 53/573 X |
| 3,807,122 | 4/1974 | Kihnke et al. | 53/572 X |
| 3,916,603 | 11/1975 | Kristiansen | 53/384 |

FOREIGN PATENT DOCUMENTS

| | | | |
|---|---|---|---|
| 2131126 | 1/1973 | Fed. Rep. of Germany | 53/573 |

*Primary Examiner*—L. J. Paperner

*Attorney, Agent, or Firm*—Larson, Taylor and Hinds

[57] ABSTRACT

A device for seizing a bag from a pack of bags provided with two jaws movable towards each other, said jaws having a sharp edge, and a pushing device for pushing said jaws against the outermost bag of said pack of bags, said jaws grip the bag and remove it from the pack of bags.

8 Claims, 6 Drawing Figures

DEVICE AND METHOD FOR SEIZING A BAG

The invention relates to a device for seizing, opening and or taking along of a bag, provided with a storage station for containing a pack of bags with the bags laying against each other, and a seizing device for gripping the outermost one of the pack of bags, and to a method for seizing a bag from a pack of bags.

To enable an easier seizing of a bag it is known to use an air-stream and/or sub-pressure. Also it is possible to insert a member in the bag and to free in that way one bag rim.

The invention aims to provide a simple and efficacious construction with which a high reliability of the working is obtained with thin bags of plastic material, for instance polyethylene.

The above aims are attained according to the invention in that the gripping device is provided with two jaws movable towards each other, which can move in the outer plane of the said outermost bag, and in that pushing means are provided for causing the jaws to exert a pushing force on the outermost bag.

According to a further elaboration of the invention it is provided that the jaws have a sharp end for instance a sharp end rim, with which it also has been shown to be favourable to chose for the jaws a material with a high friction coefficient, in which case specially good results have been obtained with Adiprene and rubber. Adiprene is a trade name of the firm DuPont for a polyurethane artificial rubber. Of course other materials having the same or corresponding characteristics can give the same results.

According to a still further elaboration of the invention it is provided that the jaws, which in the position in which they have been moved towards each other, can move away from the pack of bags.

Still a further elaboration consists in that the pushing means contains a bias device which permanently exerts a bias force towards the pack and towards the jaws, an inhibiting device being present which can inhibit the bias device and which is coupled to the jaws, such that the bias force is interrupted when the jaws have been moved away from the pack of bags.

To prevent that, when the bias force is not inhibited the pushing means push the whole pack away, it can be provided according to a further elaboration of the invention that a retaining member for the pack of bags is present, which is coupled to the jaws, such, that with a movement of the jaws away from the pack of bags the retaining member moves in a less degree away from the pack of bags.

By reason of this not only a superfluous movement too and fro of the pack of bags is excluded: When afterwards the bias force is inhibited and the retaining member moved a little away from the bags, the advantage is obtained that the bag is loosened completely.

Further the invention encompasses a method for removing the outermost bag from a pack of bags. More specifically herewith a method is considered for bags having opening rims of unequal height, in which holes are provided in the rim portion having the greatest height and retaining pins are inserted through said holes. Such packs of bags are known per se and have the advantage that they can easily be filled into a storage station or such like, whereas removing the bags from the pins is possible in a way known in itself by tearing the bags from the pins when the bag has been gripped well, for which purpose an incision can be applied at the innerside of the bagholes through which the pins are inserted.

The method according to the invention is characterized in that with a pair of jaws the lower rim portion is gripped by carrying out a scraping movement along said rim and in that afterwards the jaws are moved away from said pack of bags.

It has been shown that this method gives extraordinary satisfying results for bags of polyethylene if the jaws are from Adiprene.

The invention is elucidated on hand of the accompanying drawing, in which

FIG. 1 schematically shows a side elevation of a device according to the invention;

Figure 1:
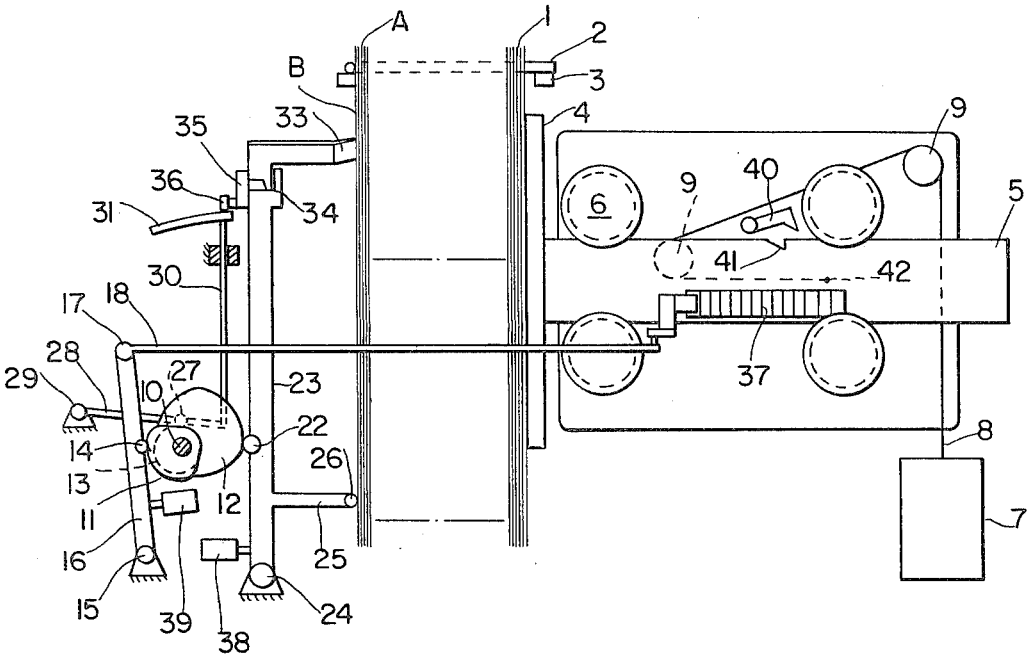
Figure 2:
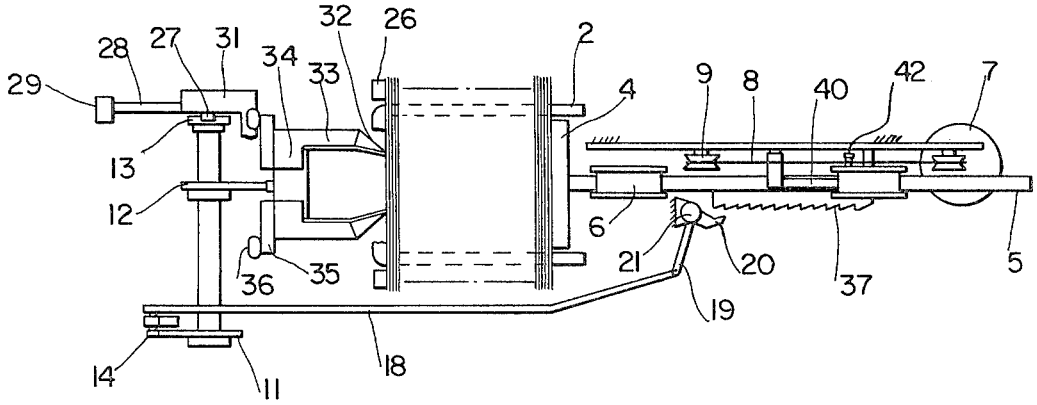
FIG. 2 is a plan view, also schematically, of the device of FIG. 1.
Figure 3:
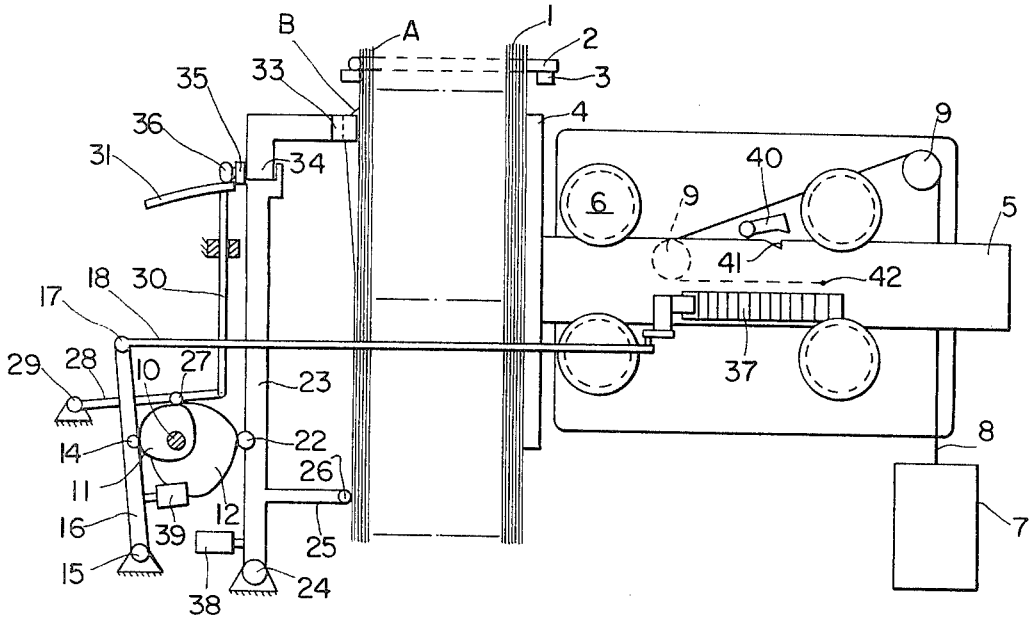
FIG. 3 shows the device of FIG. 1 in a further working position.
Figure 4:
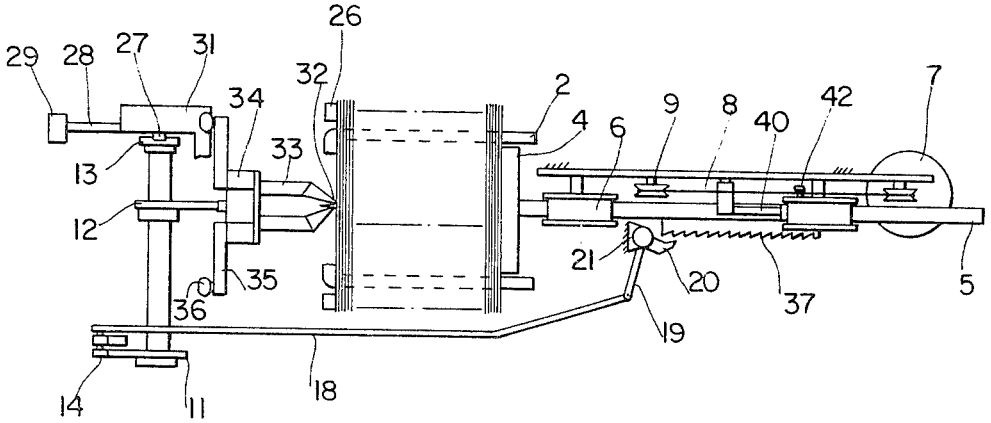
Figure 5:
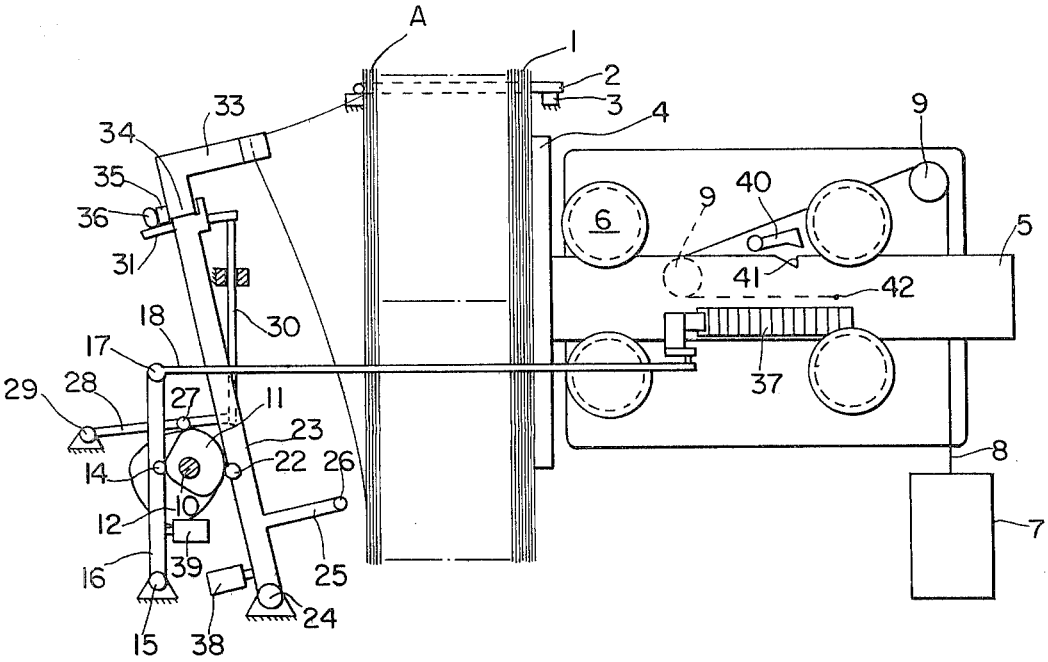
Figure 6:
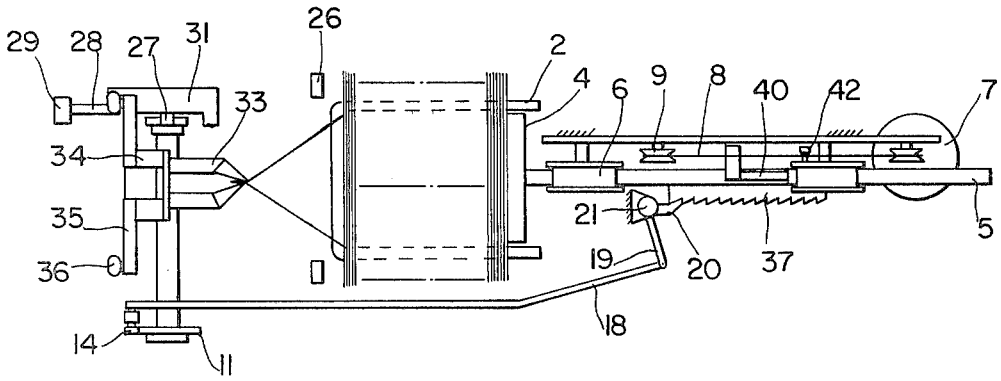

FIG. 4 indicates the working position of FIG. 3 in the plan view of FIG. 2;

FIG. 5 elucidates still a further working position, corresponding to the elevation of FIG. 1; and FIG. 6 is the plan view of the device in the position of FIG. 5.

A pack of bags 1 has been provided on an U-shaped brace 2 by means of holes applied in the higher rim portions or main flaps A.

Each bag is provided at its left side in FIG. 1 with a lower rim portion B, of which for clarity's sake only that portion of the outermost bag has been indicated.

The U-shaped brace 2 rests on a mounting frame 3, preferably in such a way, that it easily can be removed or mounted respectively, which is important for quick application of a new stock of bags, either because another type of bag is necessary or because the old stock has been finished.

At the right side a pushing plate 4 pushes the pack of bags 1, which plate is connected to a horizontal lever 5, that is supported by rolls 6. To the lever 5 at 42 a wire or cord 8 is connected which runs over fixedly located guide rolls 9 and bears a weight 7. By reason of this in FIGS. 1, 3 and 5 the lever 5 exerts permanently a force on plate 4 towards the left.

At the left side of the pack of bags a taking-off device is located, which is driven by a shaft 10. On this shaft three cams 11, 12 and 13 are provided. The cam 11 cooperates with a follow roller 14, rotatably supported on a rod 16 that at 15 is pivotably mounted and by means of pivot 17 is connected to a link 18, which is connected to an arm 19 (FIG. 2), fixedly connected to a ratchet 20, that is pivotably mounted to a fixedly mounted shaft 21. A weight 39 is connected to the rod 16, causing a clockwise bias torque to act on this rod.

The cam 12 cooperates with a follow roller 22, which is mounted to a pivotable frame 23, the fixed pivot axis of which has been indicated at 24. An arm 25 is fixedly connected to the frame 23 and supports at its end a rod 26.

The cam 13 cooperates with a follow roller 27 mounted to an arm 28 which can pivot about a fixed pivot axis 29. At the end of the arm 28 a control member 30 has been mounted that at its upper side is provided with curved faces 31, the center of curvature of these faces being located in the axis 24 or near so.

Two jaws 33 are pivotably mounted in the frame 23, which jaws end in sharp edges 32. The end portions of the jaws 33 having the sharp edges 32 may be made of Adiprene. The jaws 33 are pivotable about axes 34 and connected to arms 35 that bear control rollers 36. These control rollers rest on the curved faces 31 that are connected to the control member 30.

The working of the described device is the following. When a pack of bags 1 has been applied and the device is in the position of FIGS. 1 and 2, the shaft 10 is rotated. This causes the cam 13 to lift the member 30, 31 by reason of which the control rollers 36 move by means of the arms 35 the jaws 33 towards each other, wherewith the edges 32 run along the lower rim portion B of the outermost bag and, as experience has shown, take along this rim portion and clamp it between them. In this state the pushing plate 4 exerts a force on the pack of bags that supports the seizing action of the jaws 33.

This condition has been shown in FIGS. 3 and 4. In the phase that now follows the shape of cam 12 allows the roller 22 to move towards the left, with which a weight 38 causes the frame 23 to pivot counter-clockwise about pivot 24. Consequently the pair of jaws begins to sway the rim B of the outermost bag to the left towards the position of FIGS. 5 and 6.

In the meantime, however, the cam 11 is active, by reason of which the rod 18 is moved to the right and by means of arm 19 the ratchet is brought into the path of the toothed rack 37. By reason of this the pushing force, that the plate 4 exerted on the pack of bags 1, is intercepted, so that the position of FIGS. 5 and 6 can occur.

In this position the bag can, for instance from the inside, be seized and pulled away. This can happen in many ways, as well by hand as mechanically and is no part of this invention, so that it has not been shown in the drawing.

After this device returns to the position of FIGS. 1 and 2, with which the ratchet 20 only disengages the rack 37 after that the jaws have been completely pivoted back. Moving away from each other of the jaws occurs before the ratchet 20 makes the rack 37 free again.

The construction indicated in the above give the possibility that the bags already with the scraping movement of the jaws are submitted a sufficient force of the pushing plate 4, irrespective whether the pack of bags is thick or thin.

Further replacement of the pack of bags is very easy.

What I claim is:

1. Device for seizing, opening and/or taking along of a bag, provided with a storage station for containing a pack of bags with the main planes of the bags laying next to each other, a gripping device containing two jaws, said jaws being movable toward each other in the main plane of the outermost bag of the pack and together away from said pack of bags, a pushing means for causing the jaws to exert a pushing force on said outermost bag, an inhibiting device which can inhibit the pushing means to exert said pushing force, and a coupling means between the inhibiting device and the jaws to cause the inhibiting device to inhibit the pushing force when the jaws are moving way from the pack of bags.

2. Device according to claim 1 in which the jaws each have a sharp end portion for instance a sharp end edge.

3. Device according to claim 2, in which the ends of the jaws are made of a material giving a high friction coefficient with the material of the bags.

4. Device according to claim 3, in which the ends of the jaws are of Adiprene.

5. Device according to claim 1, in which a retaining member for the pack of bags is present, which is such like coupled to the jaws that with the movement of the jaws away from the pack of bags the retaining member moves in a less degree away from the pack of bags.

6. Device according to claim 1, in which the pushing means are connected to a toothed rack and in which a ratchet is present which is such like coupled to the jaws, that the ratchet engages the rack when the jaws are moved away from the pack of bags.

7. Device according to claim 1, in which the jaws are pivotably mounted in a pivotable frame and coupled to control members which can be controlled by a movable activation member, that is provided with a curved supporting surface for cooperation with the control members, the centre of curvature of the supporting surface being located in the pivot axis of the said pivotable frame.

8. Device according to claim 1, in which three cams, that are concurrently driven and follower members are present that control the inhibiting device, the closing movement of the jaws and the movement of the jaws away from the pack of bags respectively.

* * * * *